US011022927B1

(12) United States Patent
Akaike et al.

(10) Patent No.: US 11,022,927 B1
(45) Date of Patent: Jun. 1, 2021

(54) IMAGE FORMATION DEVICE

(71) Applicant: FUJI XEROX CO., LTD., Tokyo (JP)

(72) Inventors: Takashi Akaike, Yokohama (JP); Kazuaki Iikura, Yokohama (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/994,292

(22) Filed: Aug. 14, 2020

(30) Foreign Application Priority Data

Mar. 19, 2020 (JP) ..... JP2020-049953
Mar. 19, 2020 (JP) ..... JP2020-049954

(51) Int. Cl.
*G03G 15/00* (2006.01)
*G03G 21/16* (2006.01)

(52) U.S. Cl.
CPC ..... *G03G 15/80* (2013.01); *G03G 21/1652* (2013.01); *G03G 21/1661* (2013.01)

(58) Field of Classification Search
CPC . G03G 15/80; G03G 21/1652; G03G 21/1661
USPC ..... 399/75, 88–90, 107, 110
See application file for complete search history.

(56) References Cited

U.S. PATENT DOCUMENTS 8,958,714 B2 * 2/2015 Matsuno ..... G03G 21/1652 399/90
9,513,597 B2 * 12/2016 Amano ..... G03G 21/1821
9,715,199 B2 * 7/2017 Yoshida ..... G03G 15/2035
2010/0310283 A1 12/2010 Okamoto

FOREIGN PATENT DOCUMENTS

JP 2010282124 A 12/2010

* cited by examiner

*Primary Examiner* — Hoan H Tran
(74) *Attorney, Agent, or Firm* — Sughrue Mion, PLLC

(57) ABSTRACT

An image formation device includes: a first unit for image formation, attachably and detachably disposed in the image formation device, a power source unit configured to supply electric power to the first unit, a second unit for image formation, attachably and detachably, independently of the first unit, disposed in the image formation device, and disposed between the first unit and the power source unit and a power supply path provided in the second unit, and configured to be supplied with the electric power from the power source unit and supply the electric power to the first unit.

20 Claims, 10 Drawing Sheets

IMAGE FORMATION DEVICE

CROSS-REFERENCE TO RELATED APPLICATIONS

This application is based on and claims priority under 35 USC 119 from Japanese Patent Applications No. 2020-049953 and No. 2020-049954 which were filed on Mar. 19, 2020.

BACKGROUND

1. Technical Field

The present invention relates to an image formation device.

2. Related Art

JP-A-2010-282124 discloses a technology related to an image formation device. In this related-art technology, the image formation device includes: a fixed frame provided with a transfer roll; a plurality of fixed side supporting rolls provided on the fixed frame; a movable frame swingably attached to the fixed frame and provided with a plurality of transfer rolls; a movable side supporting roll provided on the movable frame; and an endless belt configured to be in contact with a transfer roll provided on a frame, which is stretched and fixed to the fixed side supporting roll and the movable side supporting roll, and the transfer roll supported by the movable frame and to be in contact with a plurality of photosensitive drums. A swing center of the movable frame is at a center of a belt portion on both sides of the swing center, and in a monochrome mode, the movable frame swings to separate the belt from the photosensitive drums other than the monochrome mode.

SUMMARY

When a power supply path from a power source unit to a unit involved in image formation as a power supply target is provided in a device housing, a space for providing the power supply path in the device housing is required.

Aspects of non-limiting embodiments of the present disclosure related to an image formation device that is capable of reducing a device width of an image formation device as compared with a case where a power supply path is provided in a device housing.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided an image formation device comprising a first unit for image formation, attachably and detachably disposed in the image formation device, a power source unit configured to supply electric power to the first unit, a second unit for image formation, attachably and detachably, independently of the first unit, disposed in the image formation device, and disposed between the first unit and the power source unit, and a power supply path provided in the second unit, and configured to be supplied with the electric power from the power source unit and supply the electric power to the first unit.

BRIEF DESCRIPTION OF DRAWINGS

Exemplary embodiments of the present invention will be described in detail based on the following figures, wherein.

DETAILED DESCRIPTION

Figure 1:
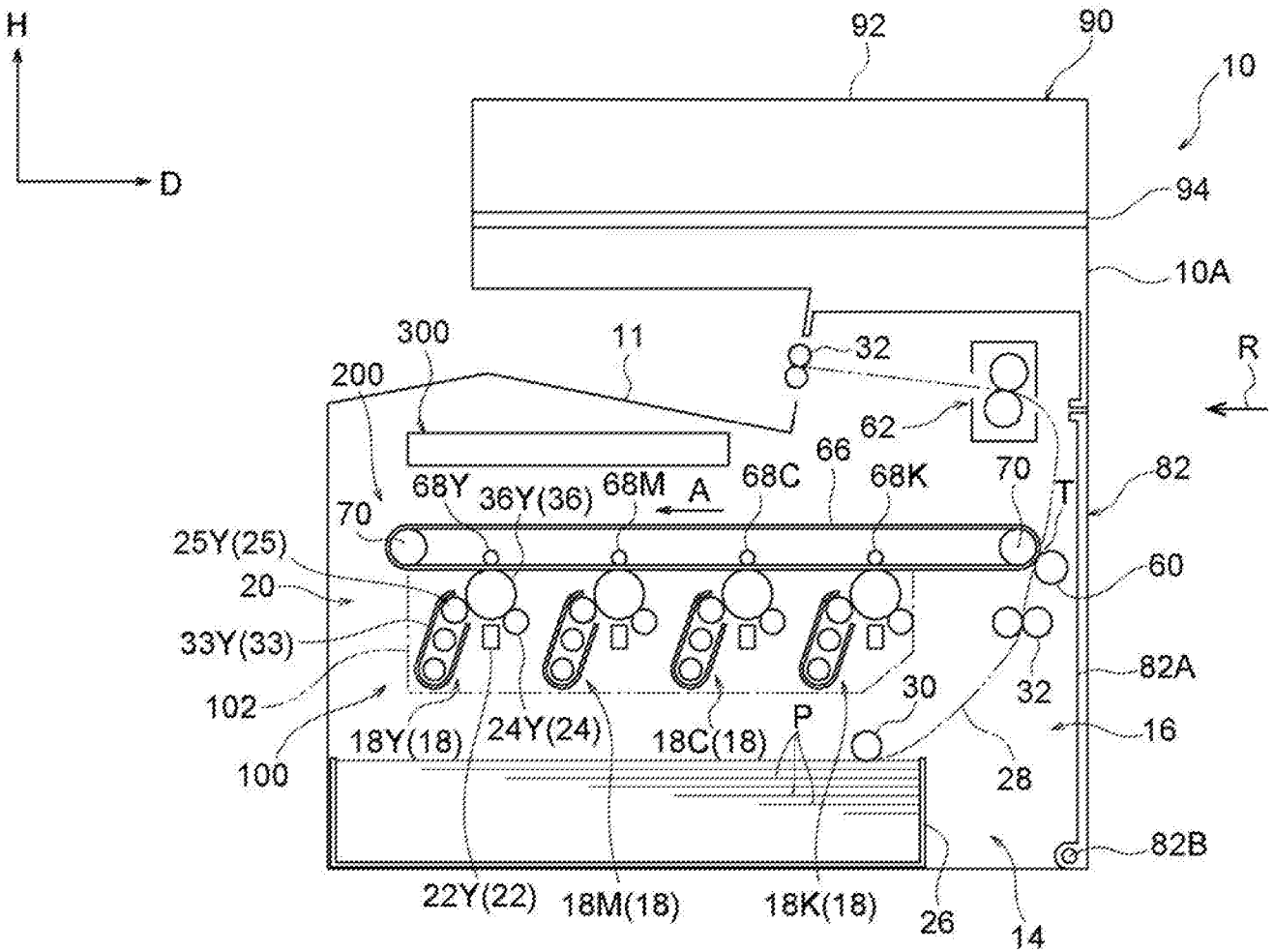
FIG. 1 is an overall configuration diagram of an image formation device according to an exemplary embodiment of the present invention.

An example of an image formation device according to an exemplary embodiment of the present invention will be described.

<Overall Configuration>

First, an overall configuration of the image formation device will be described. As shown in the drawings, an arrow H indicates a device upper-lower direction (a vertical direction), an arrow W indicates a device width direction (a horizontal direction), and an arrow D indicates a device depth direction (a horizontal direction).

The device width direction in the present exemplary embodiment is a rotation axis direction of an intermediate transfer belt 66 as an example of an intermediate transfer member described below. A device width in the present exemplary embodiment is the entire length of an image formation device 10 in the device width direction.

A stacking direction of a first unit 100, a second unit 200 and a power source unit 300 described below in the present exemplary embodiment is the device upper-lower direction.

[Image Formation Device]

As shown in FIG. 1, the image formation device 10 according to the present exemplary embodiment includes: an accommodation portion 26 in which a sheet member P as a recording medium is accommodated from a lower side to an upper side in the upper-lower direction (a direction of the arrow H); a conveyance unit 16 that conveys the sheet member P such as recording paper as the example of the recording medium accommodated in the accommodation portion 26; an image formation member 20 that forms an image on the sheet member P conveyed from the accommodation portion 26 by the conveyance unit 16; the power source unit 300, and an image reading unit 90 that reads the image written on a document.

The image formation device 10 further includes a device housing 10A that accommodates therein the conveyance unit 16, the accommodation portion 26, the image formation member 20, the power source unit 300 and the like.

(Accommodation Portion)

The accommodation portion 26 may be pulled out frontward from the device housing 10A of the image formation device 10 in the device depth direction, and the sheet member P is stacked in the accommodation portion 26. The accommodation portion 26 is provided with a delivery roll 30 that delivers the uppermost sheet member P stacked in the accommodation portion 26 to a conveyance path 28 constituting the conveyance unit 16.

(Conveyance Unit)

The conveyance unit 16 is provided with a plurality of conveyance rolls 32 that convey the sheet member P along the predetermined conveyance path 28.

(Image Formation Member)

The image formation member 20 is provided with the first unit 100 having image formation units 18Y, 18M, 18C, 18K of four colors yellow (Y), magenta (M), cyan (C) and black (K). The image formation member 20 further includes exposure devices 22Y, 22M, 22C, 22K of each color that irradiate image carriers 36Y, 36M, 36C, 36K provided in the image formation units 18Y, 18M, 18C, 18K of each color with exposure light. In the following description, Y, M, C, K may be omitted when Y, M, C, K need not be distinguished from each other.

The image formation member 20 includes the second unit 200 provided with the endless intermediate transfer belt 66 that circulates in a direction of an arrow A in the drawing, and a primary transfer roll 68 that transfers a toner image formed by the image formation unit 18 of each color onto the intermediate transfer belt 66.

The image formation member 20 includes a secondary transfer roll 60 that transfers the toner image of the intermediate transfer belt 66 onto the sheet member P, and a fixing device 62 that heats and pressurizes the sheet member P to fix the toner image on the sheet member P.

(Exposure Device)

The exposure device 22 is provided for each color, and is disposed below the image carrier 36 of each color so as to face the image carrier 36 of each color in the device upper-lower direction. The exposure device 22 of each color is attached to the device housing 10A of the image formation device 10. The exposure device 22 irradiates a surface of the charged image carrier 36 with the exposure light to form an electrostatic latent image on the surface of the image carrier 36.

(First Unit)

The first unit 100 includes the image formation units 18 of four colors and a first unit housing 102 that integrally accommodates the image formation units 18 of four colors. A removable toner box, a waste toner box and the like (not shown) are connected to outside of the first unit 100 in the device width direction. Details of the first unit 100 will be described in [configuration of main parts] below.

(Image Formation Unit)

The image formation unit 18 of each color provided in the first unit 100 includes the image carrier 36 whose rotation axis direction is the device width direction, a charging roll 24 that charges the surface of the image carrier 36, and a development device 33 having a development roll 25 that develops the electrostatic latent image formed by irradiating the surface of the charged image carrier 36 with the exposure light to visualize the electrostatic latent image as the toner image. The color image formation units 18Y, 18M, 18C, 18K of four colors are arranged in this order from a front side to a back side in the device depth direction.

In the present exemplary embodiment, the "front side in the device depth direction" is a side facing a user who uses the image formation device 10. In the present exemplary embodiment, the rotation axis direction of the image carrier 36 is the device width direction.

(Second Unit)

The second unit 200 includes the intermediate transfer belt 66, the primary transfer roll 68, a pair of tension rolls 70 around which the intermediate transfer belt 66 is wound and whose rotation axis direction is the device width direction, and roll support members 204A, 204B (see FIG. 6 and the like) that integrally support the parts.

The pair of tension rolls 70 are spaced apart from each other in the device depth direction. The intermediate transfer belt 66 is wound around the pair of tension rolls 70, and the image carrier 36 of each color is in contact with the intermediate transfer belt 66 from below the intermediate transfer belt 66. A plurality of primary transfer rolls 68 are provided for each color, and are disposed on a side opposite to the image carrier 36 with the intermediate transfer belt 66 interposed therebetween.

When a rotation driving force is transmitted to one of the tension rolls 70 to rotate one tension roll 70, the intermediate transfer belt 66 circulates in the direction of the arrow A. The primary transfer roll 68 transfers the toner image formed on the image carrier 36 onto the circulating intermediate transfer belt 66. Details of the second unit 200 will be described in [configuration of main parts] below.

As described above, the device width direction in the present exemplary embodiment is the rotation axis direction of the intermediate transfer belt 66 as the example of the intermediate transfer member.

(Secondary Transfer Roll)

The secondary transfer roll 60 is disposed on a side opposite to the tension roll 70 on the back side in the device depth direction with the intermediate transfer belt 66 interposed therebetween. The conveyance path 28 of the sheet member P passes between the intermediate transfer belt 66 and the secondary transfer roll 60. The secondary transfer roll 60 transfers the toner image transferred onto the circulating intermediate transfer belt 66 onto the sheet member P conveyed by the conveyance rolls 32

(Power Source Unit)

The power source unit 300 shown in FIG. 1 supplies power to charging rolls 24Y, 24M, 24C, 24K and development rolls 25Y, 25M, 25C, 25K provided in the image formation units 18Y, 18M, 18C, 18K of the first unit 100; the primary transfer rolls 68Y, 68M, 68C, 68K of the second unit 200. Details of the power source unit 300 will be described in [configuration of main parts] below.

(Fixing Device)

The fixing device 62 is disposed downstream of the secondary transfer roll 60 in a conveyance direction of the sheet member P. The fixing device 62 fixes the toner image transferred onto the sheet member P on the sheet member P.

(Image Reading Unit)

Figure 2:
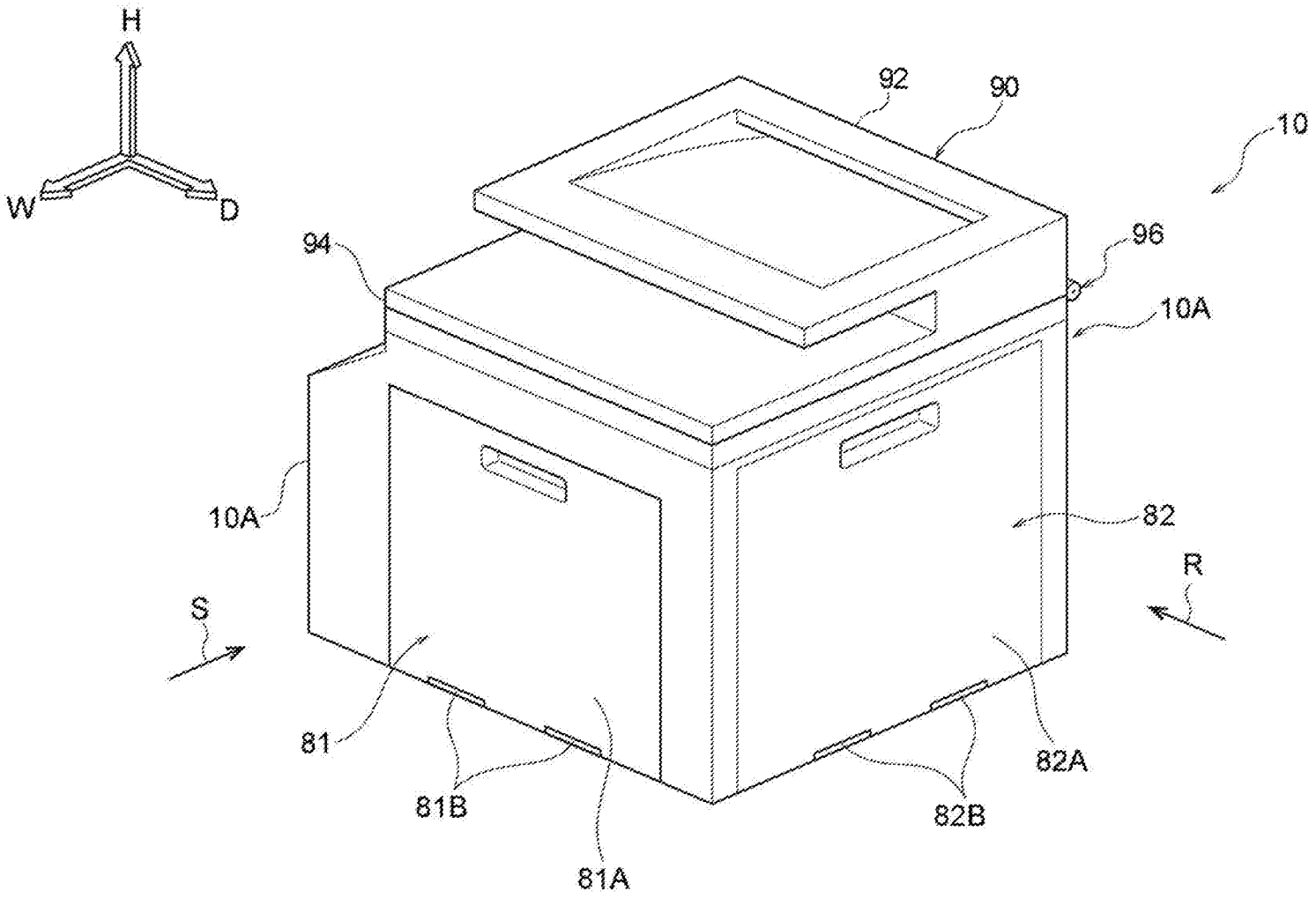
FIG. 2 is a perspective view showing the entire image formation device according to the exemplary embodiment of the present invention in a state in which first and second opening and closing doors are disposed at closed positions.
Figure 3:
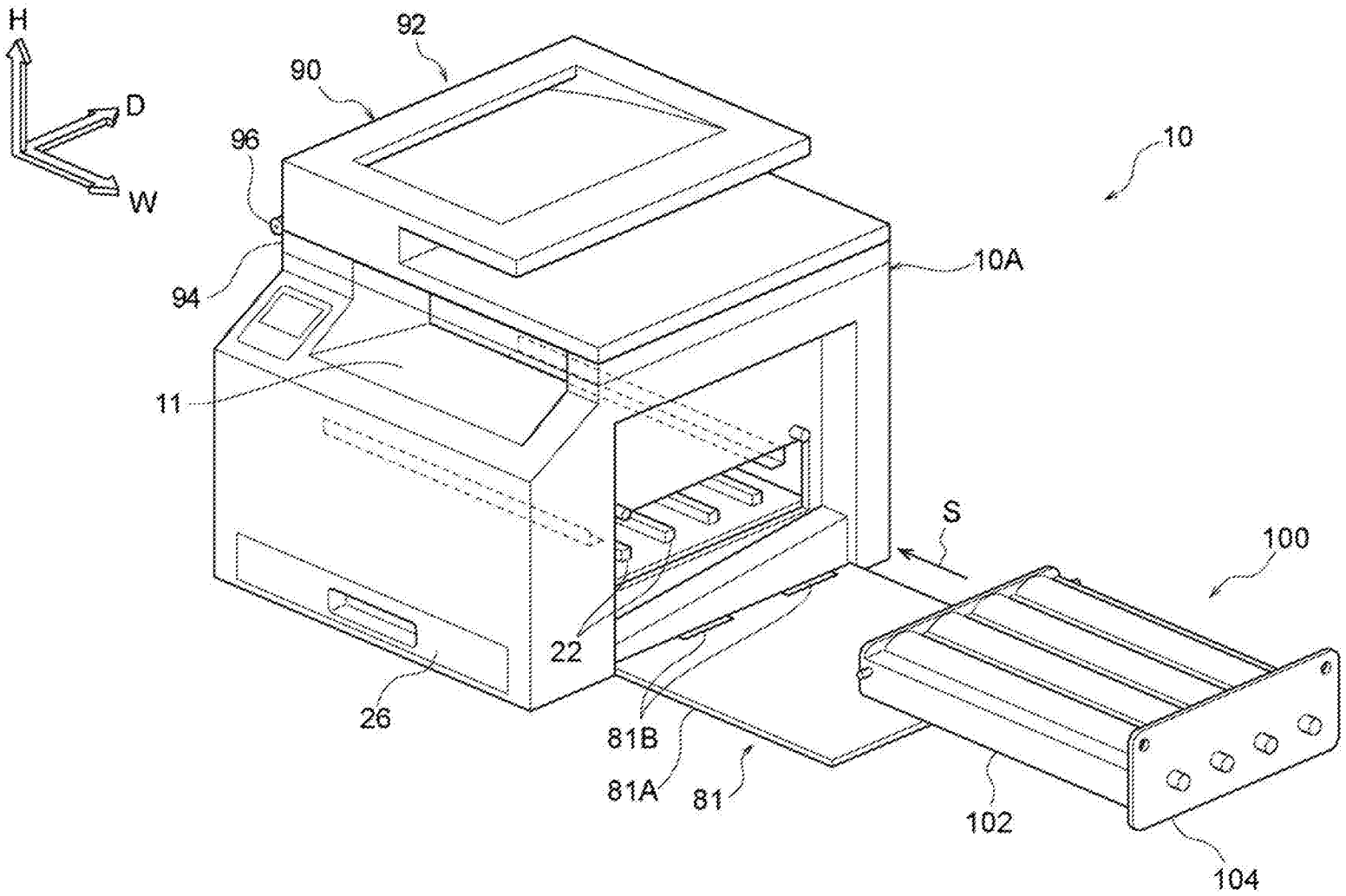
FIG. 3 is a perspective view showing the entire image formation device according to the exemplary embodiment of the present invention in a state in which the first opening and closing door is disposed at an opened position and a first unit is detached.

As shown in FIGS. 1 and 2, the image reading unit 90 is disposed in an upper portion of the device housing 10A, and includes a document conveyance unit 92 that conveys the document, and a document reading unit 94 that reads the document. The document conveyance unit 92 and the document reading unit 94 are connected by a hinge 96, and when the document conveyance unit 92 rotates about the hinge 96, the document conveyance unit 92 opens and closes a platen glass (not shown) provided in the document reading unit 94.

The image reading unit 90 reads the image written on the document conveyed by the document conveyance unit 92 or the image written on the document placed on the platen glass.

(Image Formation Process)

In the image formation device 10 shown in FIG. 1, the image is formed on the sheet member P as the example of the recording medium as follows.

The image reading unit 90 reads the image written on the document conveyed by the document conveyance unit 92 or the image written on the document placed on the platen glass.

The charging roll 24 of each color, to which power is supplied from the power source unit 300 and a voltage is applied, uniformly negatively charges the surface of the image carrier 36 of each color to a set potential.

Based on image data of the image read by the image reading unit 90, the exposure device 22 irradiates the surface of the charged image carrier 36 with the exposure light to form the electrostatic latent image. Thereby, the electrostatic latent image corresponding to the image data is formed on the surface of the image carrier 36 of each color.

The development device 33 of each color develops the electrostatic latent image by the development roll 25, to which power is supplied from the power source unit 300 and a voltage is applied, to visualize the electrostatic latent image as the toner image.

The toner image formed on the surface of the image carrier 36 of each color is transferred onto the circulating intermediate transfer belt 66 by the primary transfer roll 68, to which power is supplied from the power source unit 300 and a voltage is applied.

On the other hand, the sheet member P delivered from the accommodation portion 26 to the conveyance path 28 by the delivery roll 30 is delivered to a secondary transfer position T where the intermediate transfer belt 66 and the secondary transfer roll 60 are in contact with each other. At the secondary transfer position T, the sheet member P is conveyed while being sandwiched between the intermediate transfer belt 66 and the secondary transfer roll 60, whereby the toner image on the surface of the intermediate transfer belt 66 is transferred onto the sheet member P.

The toner image transferred onto the sheet member P is fixed on the sheet member P by the fixing device 62. Then, the sheet member P on which the toner image is fixed is discharged to a discharge unit 11 by the conveyance roll 32.

[Configuration of Main Parts]

Next, the first unit 100, the second unit 200, the power source unit 300, attachment and detachment of the first unit 100, attachment and detachment of the second unit 200, a power supply mechanism to the first unit 100 and the second unit 200, and the like, will be described. The first unit 100, the second unit 200 and the power source unit 300 in the present exemplary embodiment each have a flat box-shaped outer shape.

(Arrangement of First Unit, Second Unit and Power Source Unit)

As shown in FIG. 1, the first unit 100, the second unit 200 and the power source unit 300 each having a flat box-shaped outer shape are disposed with a thickness direction as the upper-lower direction, and the second unit 200 is disposed between the first unit 100 and the power source unit 300. From another perspective, the first unit 100, the second unit 200 and the power source unit 300 disposed with the thickness direction as the upper-lower direction are stacked in the upper-lower direction in an order of the first unit 100, the second unit 200 and the power source unit 300 from a lower side.

The first unit 100 and the second unit 200 is independently attachable to and detachable from the device housing 10A. That is, the first unit 100 is attachable and detachable regardless of whether the second unit 200 is attached or detached, and the second unit 200 is attachable and detachable regardless of whether the first unit 100 is attached or detached. Specifically, the first unit 100 is attachable and detachable whether the second unit 200 is attached or detached. Similarly, the second unit 200 is attachable and detachable regardless of whether the first unit 100 is attached or detached.

Figure 5:
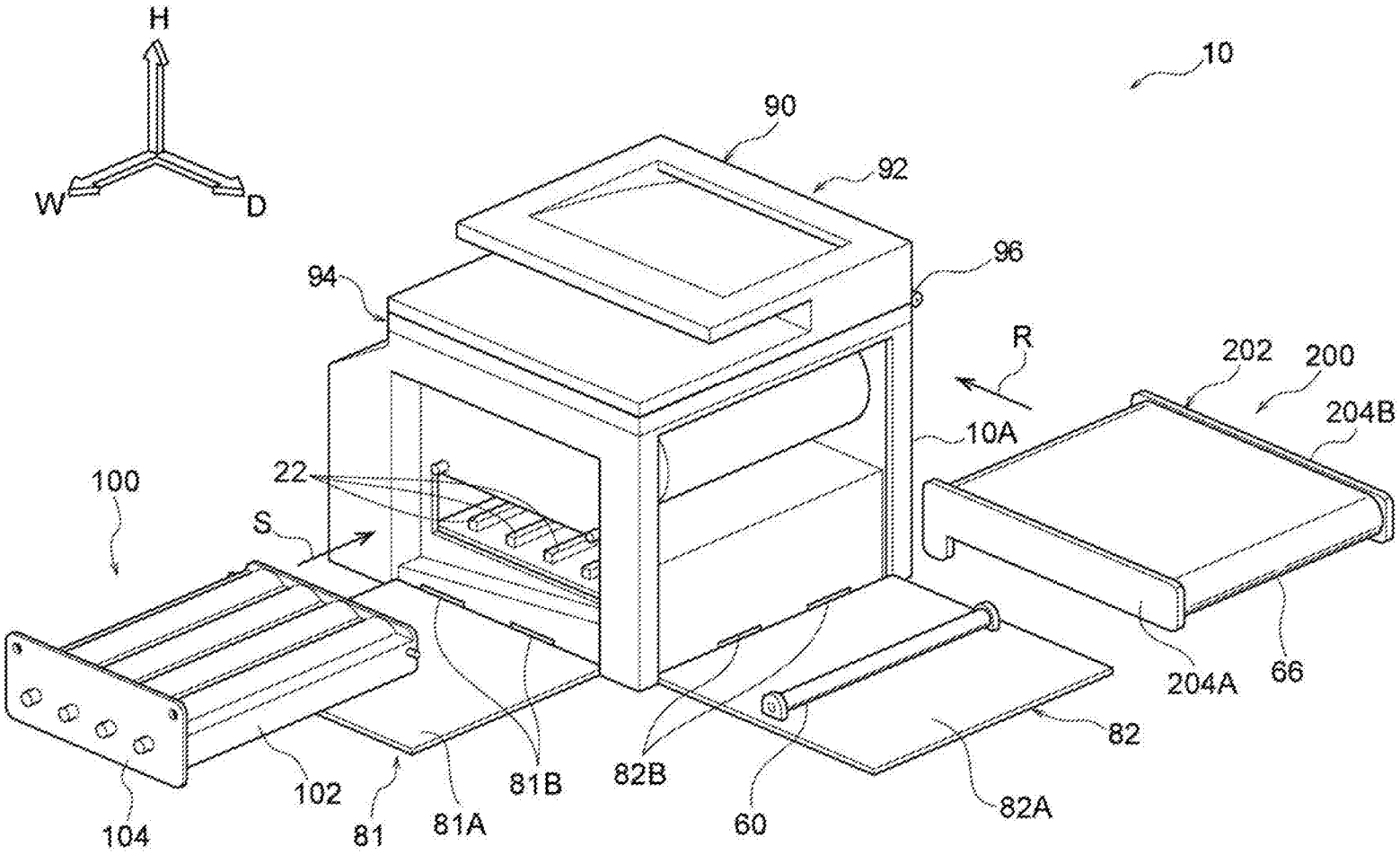
FIG. 5 is a perspective view showing the entire image formation device according to the exemplary embodiment of the present invention in a state in which both the first and second opening and closing doors are disposed at the opened positions and both first and second units are detached.

As shown in FIG. 5, the first unit 100 is attached and detached in the device width direction. An attachment direction of the first unit 100 is an S direction that is the other side direction of the device width direction. The second unit 200 is attached and detached in the device depth direction. An attachment direction of the second unit 200 is an R direction that is a front direction of the device depth direction.

(First Unit)

As described above, the first unit 100 shown in FIG. 6 includes the image formation units 18Y, 18M, 18C, 18K of four colors, and the first unit housing 102 that accommodates the image formation unit 18 of each color. An upper portion of the image carrier 36 of each color included in the image formation unit 18 is exposed upward from an opening provided in the first unit housing 102. In the first unit housing 102 is provided with a side portion 104 at one end portion in the device width direction, in other words, at a rear end portion in the attachment direction.

Figure 6:
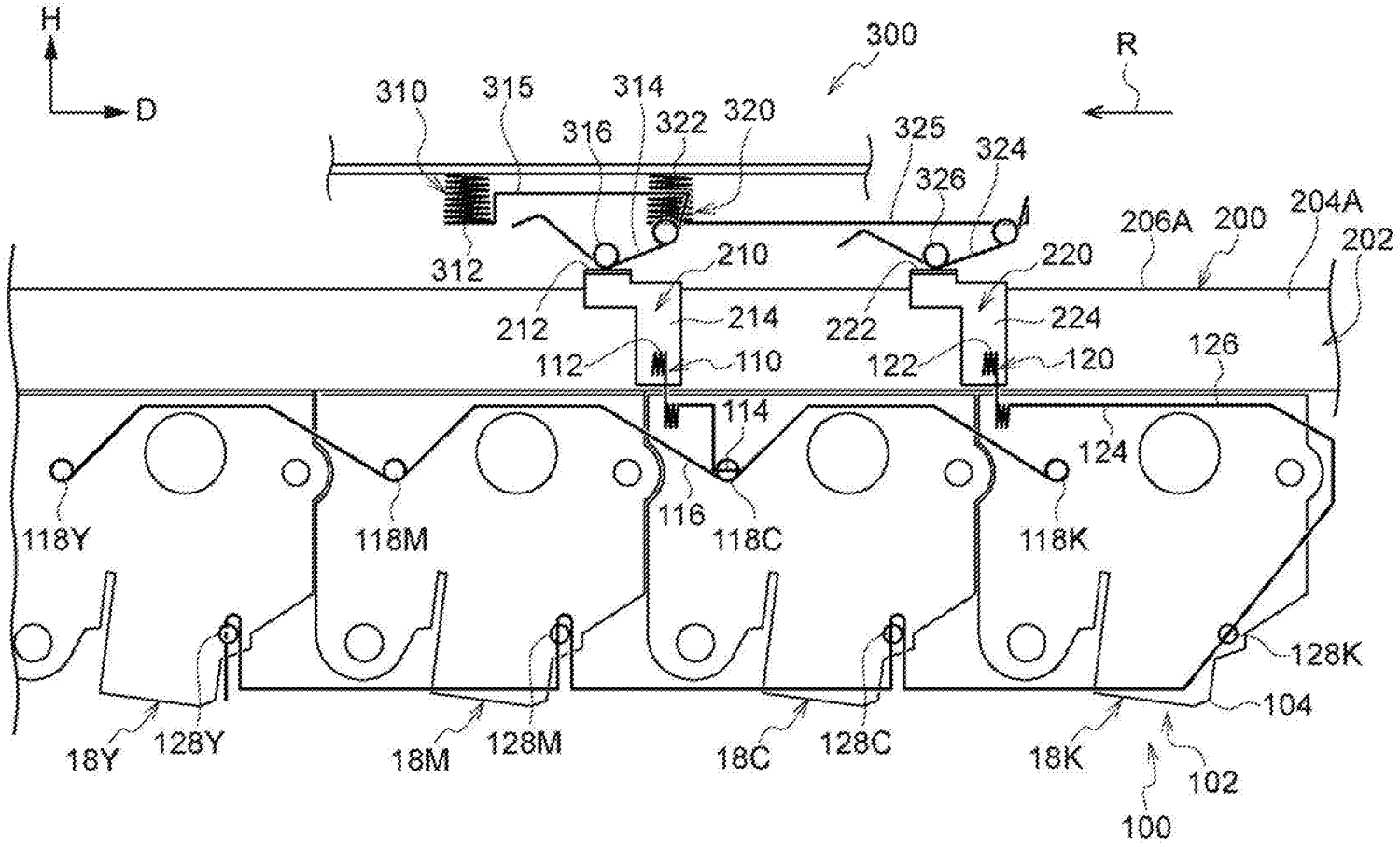
FIG. 6 is an enlarged side view of a power supply structure portion serving as a main part of the image formation device according to the exemplary embodiment of the present invention as viewed from a device width direction.
Figure 7:
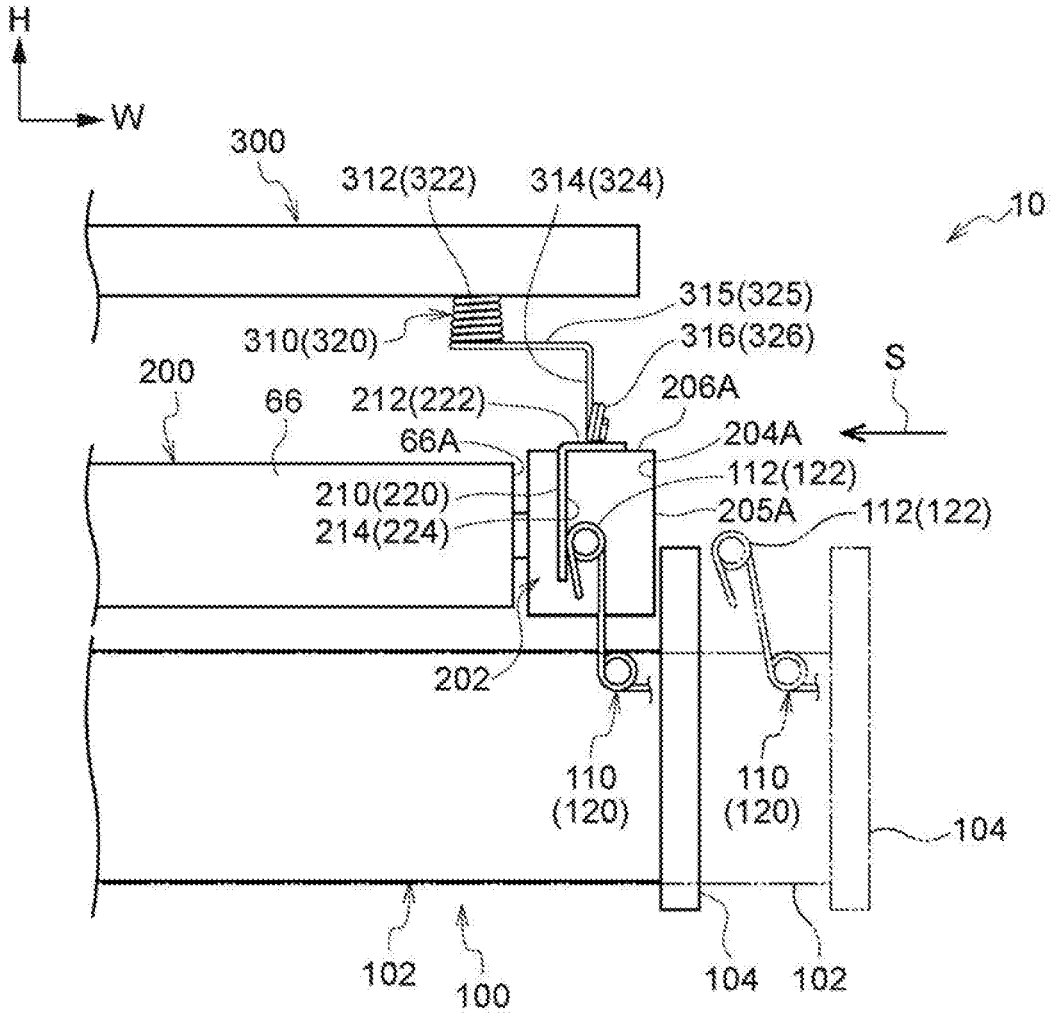
FIG. 7 is an enlarged front view of the power supply structure portion serving as the main part of the image formation device according to the exemplary embodiment of the present invention as viewed from a device depth direction.

As shown in FIGS. 6 and 7, the side portion 104 is provided with a development contact portion 110 and a charging contact portion 120, each of which is formed of an electric wire having a spring property. A coil-shaped development winding portion 112 is formed at an upper end portion of the development contact portion 110, and a coil-shaped charging winding portion 122 is formed at an upper end portion of the charging contact portion 120.

The development winding portion 112 of the development contact portion 110 and the charging winding portion 122 of the charging contact portion 120 each protrude upward from an attachment portion to the side portion 104.

Although only the development contact portion 110 is shown in FIG. 7, an upper portion of the charging contact portion 120 has a shape the same as that of an upper portion of the development contact portion 110 except that arrangement positions thereof in the device depth direction are different, as shown in FIG. 6. Therefore, the charging winding portion 122 is shown in parentheses as "112 (122)" in FIG. 7.

The development winding portion 112 of the development contact portion 110 and the charging winding portion 122 of the charging contact portion 120 are provided in vicinity of a rear end portion of the first unit 100 in the S direction as the attachment direction of the first unit 100 to the image formation device described below, that is, in vicinity of an end portion of the first unit 100 in a direction opposite to the S direction.

As shown in FIG. 6, a lower end portion 114 of the development contact portion 110 is routed in the side portion 104 and is in contact with a development terminal portion 118C electrically connected to the development roll 25Y (see FIG. 1) of the image formation unit 18C. The side portion 104 is provided therein with a development branch portion 116 formed of an electric wire having a spring property. The development branch portion 116 is routed in the side portion 104 and is in contact with development terminal portions 118Y, 118M, 118C, 118K electrically connected to the development rolls 25Y, 25M, 25C, 25K (see FIG. 1) of the image formation units 18Y, 18M, 18C, 18K. Therefore, the development contact portion 110 is electrically connected to the development rolls 25Y, 25M, 25C, 25K (see FIG. 1) via the development branch portion 116 and the development terminal portions 118Y, 118M, 118C, 118K.

As shown in FIG. 6, in the side portion 104, a charging branch portion 126 extends from a lower end portion 124 of the charging contact portion 120. The charging branch portion 126 is routed in the side portion 104 and is in contact with charging terminal portions 128Y, 128M, 128C, 128K electrically connected to the charging rolls 24Y, 24M, 24C, 24K (see FIG. 1) of the image formation units 18Y, 18M, 18C, 18K. Therefore, the charging contact portion 120 is electrically connected to the charging rolls 24Y, 24M, 24C, 24K (see FIG. 1) via the charging branch portion 126 and the charging terminal portions 128Y, 128M, 128C, 128K.

(Second Unit)

As described above, the second unit 200 shown in FIGS. 6 and 8 includes the intermediate transfer belt 66, the primary transfer roll 68 (see FIG. 1), the pair of tension rolls 70 (see FIG. 1) around which the intermediate transfer belt 66 (see FIG. 1) is wound and whose rotation axis direction is the device width direction, and a second unit housing 202 that integrally supports the parts.

The second unit housing 202 includes the roll support members 204A, 204B that constitute outer end portions of the second unit 200 in the device width direction and support both end portions of the primary transfer roll 68 (see FIG. 1) and the tension roll 70 (see FIG. 1).

As shown in FIG. 6, the roll support member 204A of the second unit 200 is provided with a development power supply path 210 and a charging power supply path 220. The development power supply path 210 and the charging power supply path 220 are provided between an outer end portion 205A of the roll support member 204A in the device width direction and an outer end portion 66A of the intermediate transfer belt 66 in the device width direction.

Figure 8:
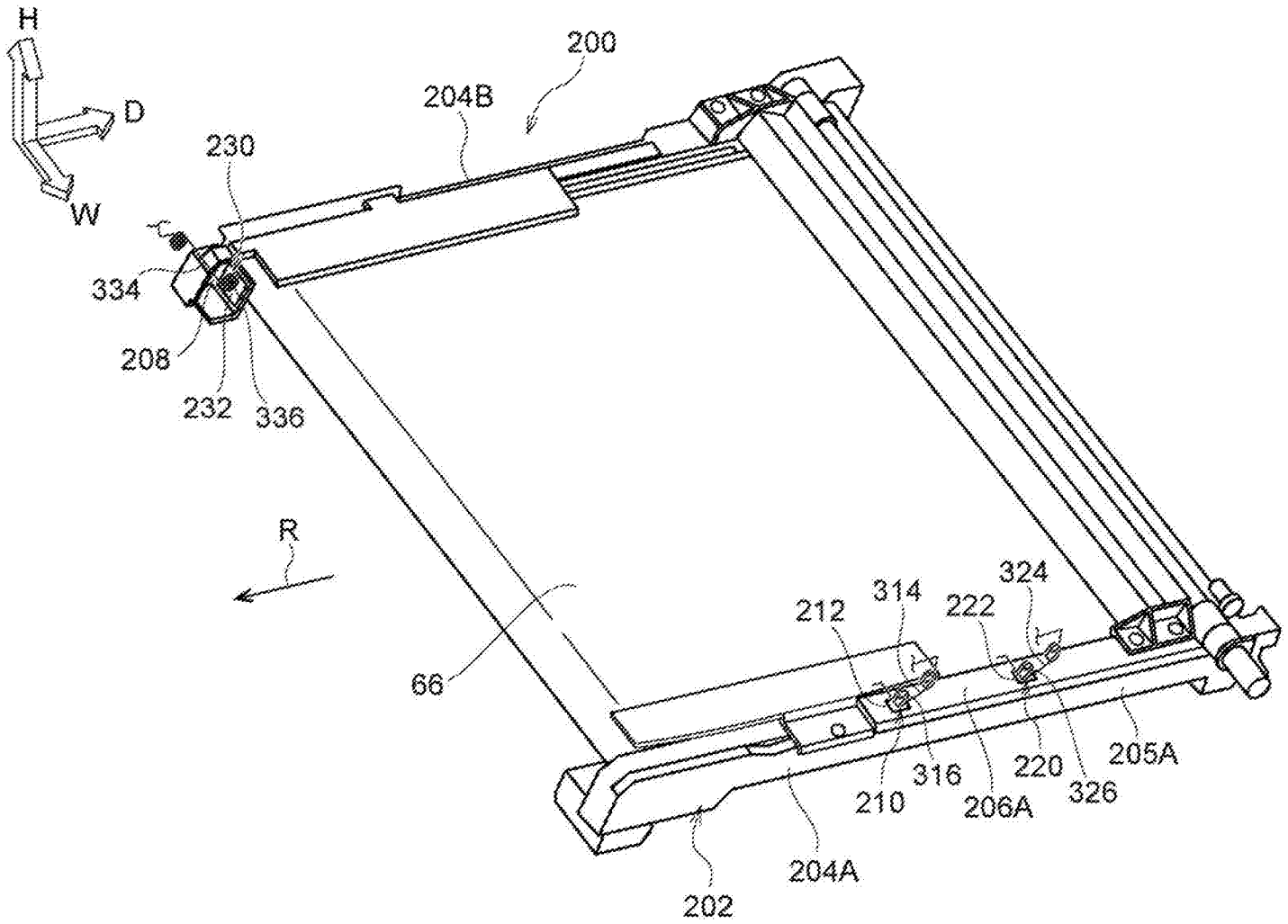
FIG. 8 is a perspective view of the second unit, a power source side development contact portion and a power source side charging contact portion.

As shown in FIGS. 6 and 8, the development power supply path 210 is provided with a development first contact portion 212 exposed toward the power source unit 300, that is, upward. In the present exemplary embodiment, the development first contact portion 212 is formed of a plate surface whose plate thickness direction is a direction on a power source unit 300 side. The development first contact portion 212 is provided more inward in the device width direction than the outer end portion 205A on an upper surface 206A of the roll support member 204A.

Similarly, the charging power supply path 220 is provided with a charging first contact portion 222 exposed toward the power source unit 300, that is, upward. In the present exemplary embodiment, the charging first contact portion 222 is formed of a plate surface whose plate thickness direction is the direction on the power source unit 300 side. The charging first contact portion 222 is provided more inward in the device width direction than the outer end portion 205A on the upper surface 206A of the roll support member 204A.

Although only the development power supply path 210 is shown in FIG. 7, the charging power supply path 220 has a shape the same as that of the development power supply path 210 except that arrangement positions thereof in the depth direction are different, as shown in FIGS. 6 and 8. Therefore, the charging power supply path 220 is shown in parentheses as "210 (220)" in FIG. 7.

As shown in FIGS. 6 and 7, the development power supply path 210 includes a development second contact portion 214 exposed rearward in the S direction as the attachment direction of the first unit 100, that is, in the direction opposite to the S direction. In the present exemplary embodiment, the development second contact portion 214 is formed of a plate surface whose plate thickness direction is the S direction.

Similarly, the charging power supply path 220 includes a charging second contact portion 224 exposed rearward in the S direction as the attachment direction of the first unit 100, that is, in the direction opposite to the S direction. In the present exemplary embodiment, the charging second contact portion 224 is formed of a plate surface whose plate thickness direction is the S direction.

The development winding portion 112 of the development contact portion 110 and the charging winding portion 122 of the charging contact portion 120 are in contact with the development second contact portion 214 and the charging second contact portion 224. The development contact portion 110 and the charging contact portion 120 having the spring property are elastically deformed, and the development winding portion 112 and the charging winding portion 122 are in contact with the development second contact portion 214 and the charging second contact portion 224.

Figure 9:
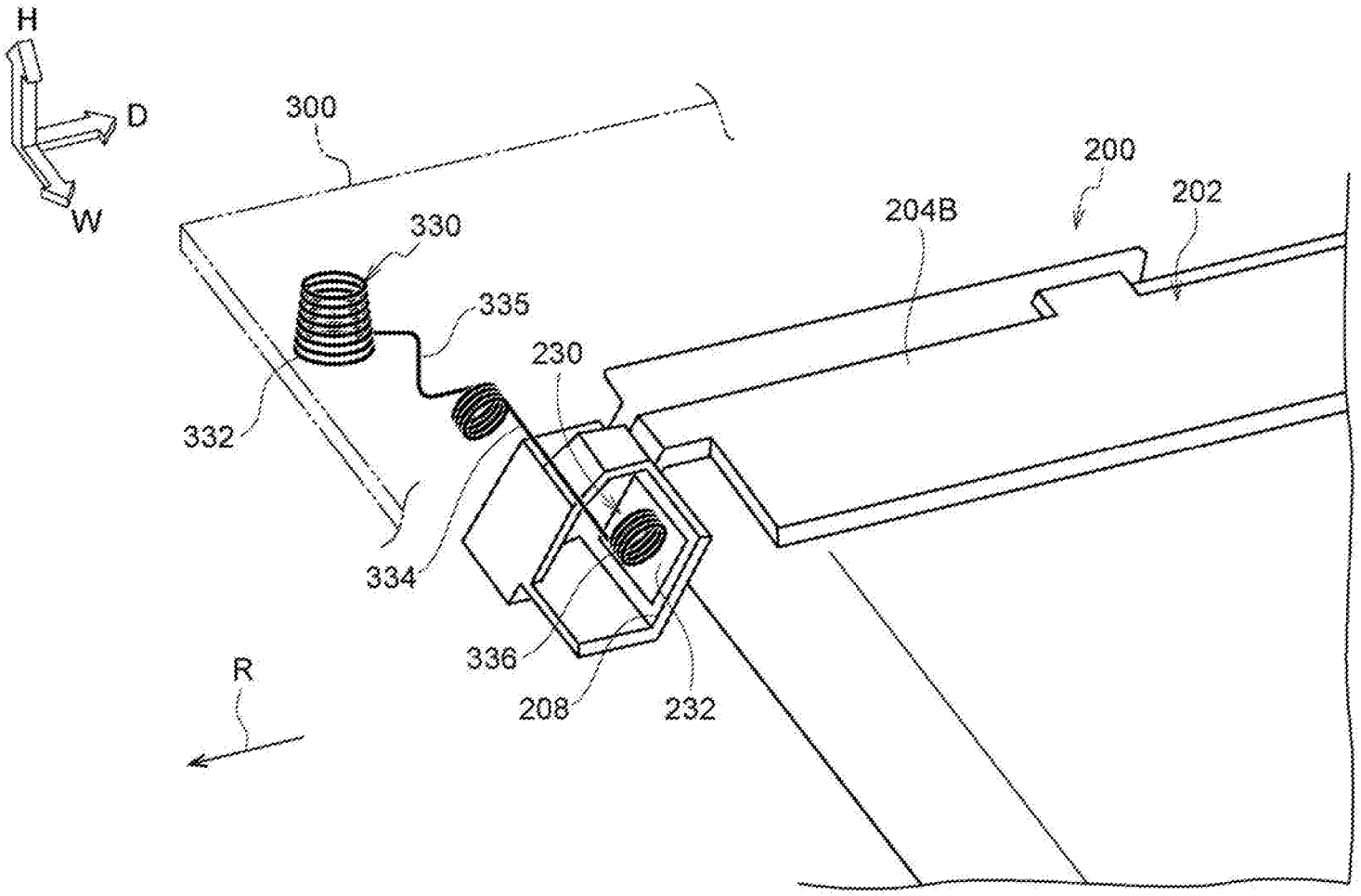
FIG. 9 is an enlarged perspective view of a power supply structure portion serving as a main part of the second unit.

As shown in FIGS. 8 and 9, a transfer power supply path 230 is provided at an end portion of the roll support member 204B of the second unit 200 in the R direction as the attachment direction. The transfer power supply path 230 is provided with a transfer contact portion 232 exposed toward an R direction side. In the present exemplary embodiment, the transfer contact portion 232 is formed of a plate surface whose plate thickness direction is the R direction.

Figure 10:
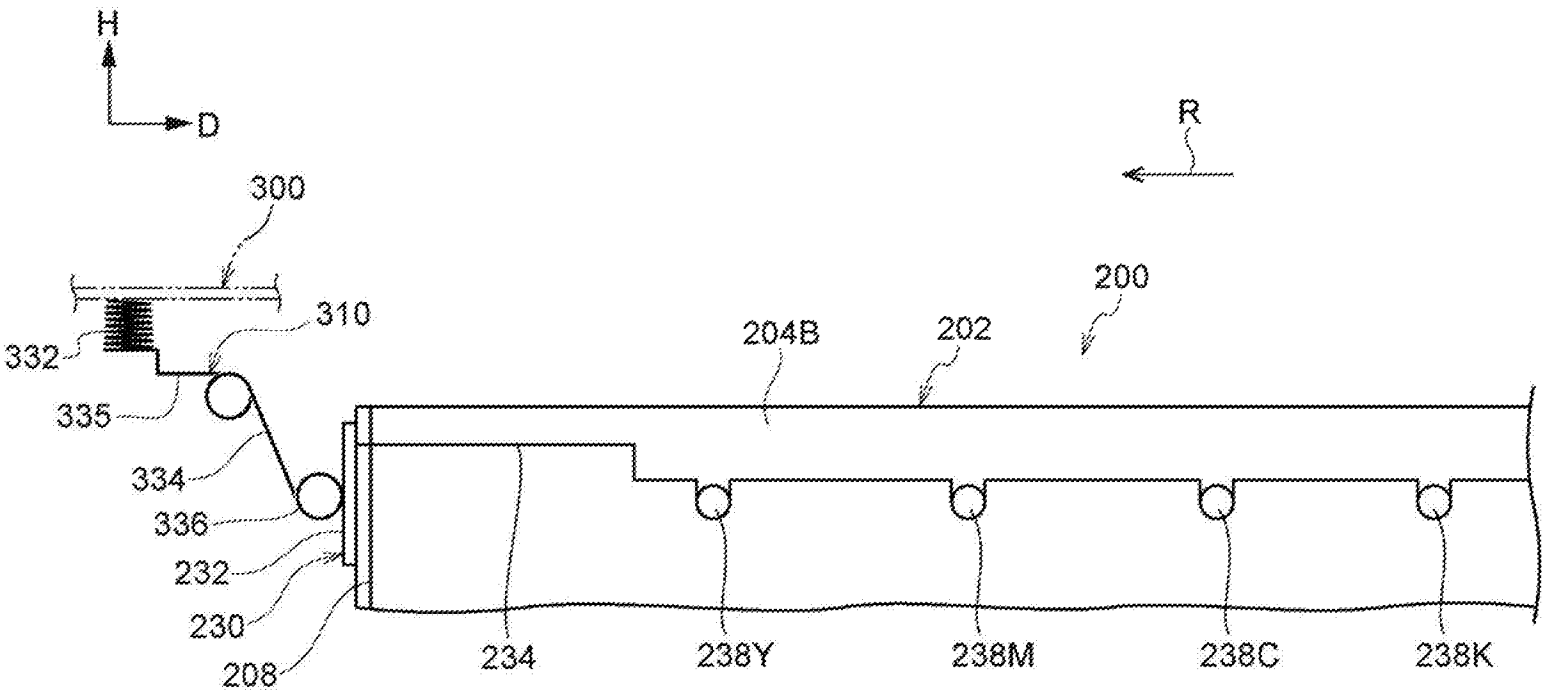
FIG. 10 is an enlarged side view of the power supply structure portion serving as the main part of the second unit as viewed from the device width direction.

As shown in FIG. 10, a transfer branch portion 234 extending from the transfer power supply path 230 is provided in the roll support member 204B. The transfer branch portion 234 is routed in the roll support member 204B and is in contact with transfer terminal portions 238Y, 238M, 238C, 238K electrically connected to the primary transfer rolls 68Y, 68M, 68C, 68K (see FIG. 1) of the second unit 200. Therefore, the transfer power supply path 230 is electrically connected to the primary transfer rolls 68Y, 68M, 68C, 68K (see FIG. 1) via the transfer branch portion 234 and the transfer terminal portions 238Y, 238M, 238C, 238K.

(Power Source Unit)

As shown in FIG. 6, the power source unit 300 is provided with a power source side development power supply path 310 and a power source side charging power supply path 320 each formed of an electric wire having a spring property.

As shown in FIGS. 6 and 7, a coil-shaped development base end portion 312 is formed at an upper end portion of the power source side development power supply path 310. As shown in FIG. 7, the development base end portion 312 is disposed closer to the roll support member 204A of the second unit 200 than a center position of the power source unit 300 in the device width direction. As shown in FIGS. 6 and 7, in the power source side development power supply path 310, a development shaft portion 315 bent in an L shape extends from the development base end portion 312, and a power source side development contact portion 314 protrudes toward the second unit 200, that is, downward, from the development shaft portion 315.

As shown in FIG. 6, the power source side development contact portion 314 is bent downward when viewed from the device width direction, and a lower end portion of the power source side development contact portion 314 which is a vertex portion of the bent portion forms a development winding portion 316 (also see FIG. 7) wound in a coil shape. As shown in FIGS. 6 and 7, the development winding portion 316 of the power source side development contact portion 314 is in contact with the development first contact portion 212. The power source side development contact portion 314 having a spring property is elastically deformed, and the development winding portion 316 is in contact with the development first contact portion 212.

When viewed from the device upper-lower direction as the stacking direction, the development winding portion 316 of the power source side development contact portion 314 overlaps the development first contact portion 212.

Although only the power source side development power supply path 310 is shown in FIG. 7, the power source side charging power supply path 320 has a shape the same as that of the power source side development power supply path 310 except that arrangement positions thereof in the depth direction are different, as shown in FIG. 6. Therefore, the power source side charging power supply path 320 is shown in parentheses as "310 (320)" in FIG. 7.

As shown in FIGS. 6 and 7, a coil-shaped charging base end portion 322 is formed at an upper end portion of the power source side charging power supply path 320. As shown in FIG. 7, the charging base end portion 322 is disposed closer to the roll support member 204A of the second unit 200 than the center position of the power source unit 300 in the device width direction. In the power source side charging power supply path 320, a charging shaft portion 325 bent in an L-shape extends from the charging base end portion 322, and a power source side charging contact portion 324 protrudes toward the second unit 200, that is, downward, from the charging shaft portion 325.

As shown in FIG. 6, the power source side charging contact portion 324 is bent downward when viewed from the device width direction, and a lower end portion of the power source side charging contact portion 324 which is a vertex portion of the bent portion forms a charging winding portion 326 (also see FIG. 7) wound in a coil shape. As shown in FIGS. 6 and 7, the charging winding portion 326 of the power source side charging contact portion 324 is in contact with the charging first contact portion 222 from above. The power source side charging contact portion 324 having a spring property is elastically deformed, and the charging winding portion 326 is in contact with the development first contact portion 222.

When viewed from the device upper-lower direction as the stacking direction, the charging winding portion 326 of the power source side charging contact portion 324 overlaps the charging first contact portion 222.

As shown in FIGS. 8 and 9, the power source unit 300 is provided with a power source side transfer power supply path 330. A coil-shaped transfer base end portion 332 is formed at an upper end portion of the power source side transfer power supply path 330. In the power source side transfer power supply path 330, a transfer shaft portion 335 bent in an L-shape extends from the transfer base end portion 332, and a power source side transfer contact portion 334 protrudes toward the second unit 200 from the transfer shaft portion 335. A transfer winding portion 336 wound in a coil shape is formed at a tip portion of the power source side transfer contact portion 334. The transfer winding portion 336 is in contact with the transfer contact portion 232 of the transfer power supply path 230 of the second unit 200.

(Attachment and Detachment of First Unit)

As shown in FIGS. 2 to 5, the device housing 10A includes a first opening and closing door 81 that is opened to one side (a left side in the drawing) in the device width direction. The first opening and closing door 81 includes a first door body 81A and first hinges 81B attached to a lower end portion of the first door body 81A. The first opening and closing door 81 is rotationally moved between a closed position (see FIG. 2) for closing inside of the device housing 10A and an opened position (see FIGS. 3 to 5) for opening the inside of the device housing 10A.

Then, the first opening and closing door 81 is opened, and the first unit 100 is attached and detached along the device width direction. The attachment direction of the first unit 100 is the S direction that is the other side direction of the device width direction.

As shown in FIG. 7, when the first unit 100 is attached to the device housing 10A, the development winding portion 112 of the development contact portion 110 and the charging winding portion 122 of the charging contact portion 120 of the first unit 100 are in contact with the development second contact portion 214 of the development power supply path 210 and the charging second contact portion 224 of the charging power supply path 220 of the second unit 200 (also see FIG. 6).

(Attachment and Detachment of Second Unit)

Figure 4:
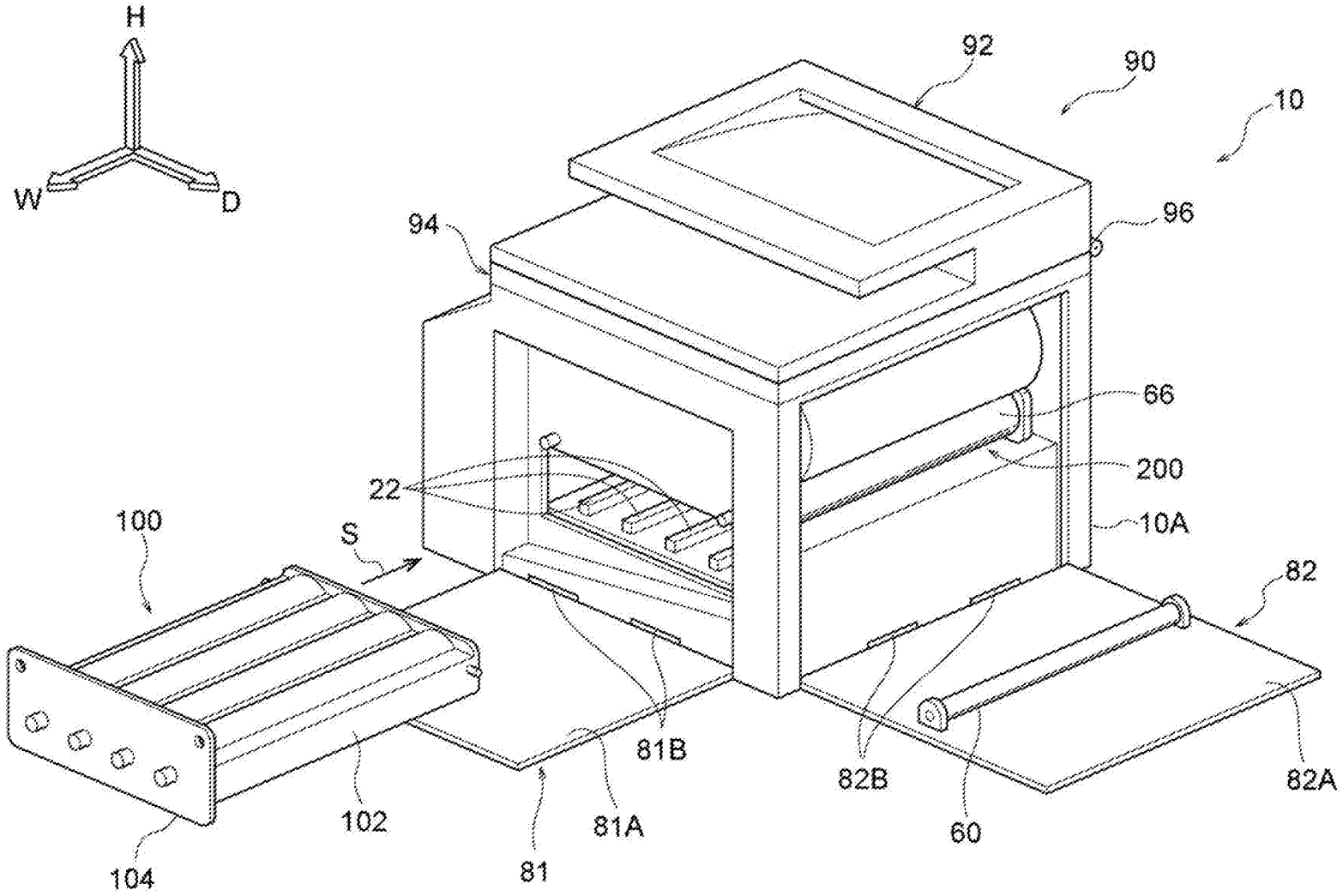
FIG. 4 is a perspective view of the entire image formation device according to the exemplary embodiment of the present invention in a state in which both the first and second opening and closing doors are disposed at opened positions and the first unit is detached.

As shown in FIGS. 1, 2, 4 and 5, a second opening and closing door 82 is provided to open the inside of the device housing 10A to the back side in the device depth direction. The second opening and closing door 82 includes a second door body 82A and second hinge 82B attached to a lower end portion of the second door body 82A. The second opening and closing door 82 is moved between a closed position (see FIGS. 1 and 2) for closing the inside of the device housing 10A and an opened position (see FIGS. 4 and 5) for opening the inside of the device housing 10A. As shown in FIGS. 4 and 5, the secondary transfer roll 60 described above is attached to the second opening and closing door 82.

Then, the second opening and closing door 82 is opened, and the second unit 200 is attached and detached along the device depth direction. The attachment direction of the second unit 200 is the R direction that is the front direction of the device depth direction.

As shown in FIG. 7, when the second unit 200 is attached to the device housing 10A, the development first contact portion 212 of the development power supply path 210 and the charging first contact portion 222 of the charging power supply path 220 of the second unit 200 are in contact with the development winding portion 316 of the power source side development contact portion 314 of the power source side development power supply path 310 and the charging winding portion 326 of the power source side charging contact portion 324 of the power source side charging power supply path 320 provided in the power source unit 300 (also see FIG. 6).

As shown in FIGS. 9 and 10, when the second unit 200 is attached to the device housing 10A, the transfer contact portion 232 of the transfer power supply path 230 of the second unit 200 is in contact with the transfer winding portion 336 of the power source side transfer contact portion 334 of the power source side transfer power supply path 330.

<Operation and Effects>

Next, operation and effects of the present exemplary embodiment will be described.

When the second unit 200 is attached to the device housing 10A, the development first contact portion 212 of the development power supply path 210 and the charging first contact portion 222 of the charging power supply path 220 of the second unit 200 are in contact with the development winding portion 316 of the power source side development contact portion 314 of the power source side development power supply path 310 and the charging winding portion 326 of the power source side charging contact portion 324 of the power source side charging power supply path 320 provided in the power source unit 300.

When the first unit 100 is attached to the device housing 10A, the development winding portion 112 of the development contact portion 110 and the charging winding portion 122 of the charging contact portion 120 of the first unit 100 are in contact with the development second contact portion 214 of the development power supply path 210 and the charging second contact portion 224 of the charging power supply path 220 of the second unit 200.

The development contact portion 110 is electrically connected to the development rolls 25Y, 25M, 25C, 25K via the development branch portion 116 and the development terminal portions 118Y, 118M, 118C, 118K.

Similarly, the charging contact portion 120 is electrically connected to the charging rolls 24Y, 24M, 24C, 24K via the charging branch portion 126 and the charging terminal portions 128Y, 128M, 128C, 128 K.

In this way, when the first unit 100 and the second unit 200 are attached, the power is supplied from the power source unit 300 to the development rolls 25Y, 25M, 25C, 25K and the charging rolls 24Y, 24M, 24C, 24K of the first unit 100 via the development power supply path 210 and the charging power supply path 220 of the second unit 200.

When the second unit 200 is attached, the transfer contact portion 232 of the transfer power supply path 230 of the second unit 200 is in contact with the transfer winding portion 336 of the power source side transfer contact portion 334 of the power source side transfer power supply path 330. The transfer power supply path 230 is electrically connected to the primary transfer rolls 68Y, 68M, 68C, 68K via the transfer branch portion 234.

In this way, when the second unit 200 is attached, the power is supplied from the power source unit 300 to the primary transfer rolls 68Y, 68M, 68C, 68K.

The development power supply path 210 and the charging power supply path 220 are provided in the second unit 200. Therefore, a device width of the image formation device 10 may be reduced as compared with a case where the development power supply path 210 and the charging power supply path 220 are provided in the device housing 10A.

When the first unit 100 is attached to the device housing 10A, a power supply path from the power source unit 300 to the first unit 100 is formed. Therefore, when the first unit 100 is not attached, the first unit 100 is not energized.

The development power supply path 210 and the charging power supply path 220 are provided in the roll support member 204A of the second unit 200. Therefore, the device width of the image formation device 10 may be reduced as compared with a case where the development power supply path 210 and the charging power supply path 220 are provided in a member more outward than the development power supply path 210 and the charging power supply path 220, for example, the device housing 10A.

The development power supply path 210 and the charging power supply path 220 are provided more inward than the outer end portion 205A of the roll support member 204 that is the outer end portion of the second unit 200 in the device width direction when viewed from the stacking direction. Therefore, the device width of the image formation device 10 may be reduced as compared with a case where the development power supply path 210 and the charging power supply path 220 are provided in the device housing 10A located outside the outer end portion 205A of the roll support member 204.

The development power supply path 210 and the charging power supply path 220 are provided between the outer end portion 205A of the roll support member 204A in the device width direction and the outer end portion 66A of the intermediate transfer belt 66 in the device width direction. Therefore, the device width of the image formation device 10 may be reduced as compared with a case where the development power supply path 210 and the charging power supply path 220 are provided outside the outer end portion 205A of the roll support member 204A in the device width direction.

The development base end portion 312 of the power source side development power supply path 310 and the charging base end portion 322 of the power source side charging power supply path 320 of the power source unit 300 are disposed closer to the roll support member 204A of the second unit 200 than the center position of the power source unit 300 in the device width direction. Therefore, the device width of the image formation device 10 may be reduced.

The device width of the image formation device 10 may be reduced as compared with a case where the development base end portion 312 of the power source side development power supply path 310 and the charging base end portion 322 of the power source side charging power supply path 320 of the power source unit 300 are disposed at the center position in the device width direction.

In addition, the development base end portion 312 of the power source side development power supply path 310 and the charging base end portion 322 of the power source side charging power supply path 320 of the power source unit 300 may be shortened.

When viewed from the device upper-lower direction as the stacking direction, the development winding portion 316 of the power source side development contact portion 314 overlaps the development first contact portion 212, and the charging winding portion 326 of the power source side charging contact portion 324 overlaps the charging first contact portion 222. Therefore, the device width of the image formation device 10 may be reduced as compared with a case where the development winding portion 316 of the power source side development contact portion 314 and the charging winding portion 326 of the power source side charging contact portion 324 are respectively outside the development first contact portion 212 and the charging first contact portion 222 in the device width direction.

The power source side development contact portion 314 and the power source side charging contact portion 324 that protrude toward the second unit 200 are formed in the power source side development power supply path 310 and the power source side charging power supply path 320 provided in the power source unit 300. In the development power supply path 210 and the charging power supply path 220 of the second unit 200, the development first contact portion 212 and the charging first contact portion 222 in contact with the power source side development contact portion 314 and the power source side charging contact portion 324, which are exposed toward the power source unit 300, are provided more inward than the outer end portion 205A in the device width direction of the roll support member 204 that is the outer end portion of the second unit 200 in the device width direction. Therefore, the device width of the image formation device 10 may be reduced as compared with a case where the development first contact portion 212 of the development power supply path 210 and the charging first contact portion 222 of the charging power supply path 220 of the second unit 200 are provided outside the outer end portion 205A in the device width direction of the roll support member 204 that is the outer end portion of the second unit 200 in the device width direction.

When the second unit 200 is attached, the development first contact portion 212 and the charging first contact portion 222 of the second unit 200 are in contact with the power source side development contact portion 314 and the power source side charging contact portion 324 provided in the power source unit 300. Therefore, when the second unit 200 is not attached, the first unit 100 is not energized.

When the first unit 100 is attached, the development contact portion 110 and the charging contact portion 120 of the first unit 100 are in contact with the development second contact portion 214 and charging second contact portion 224 which are exposed rearward in the S direction at the attachment direction of the first unit 100. In the present exemplary embodiment, the development second contact portion 214 and the charging second contact portion 224 are each formed of the plate surface whose plate thickness direction is the S direction. Therefore, the device width of the image formation device 10 may be reduced as compared with a case where the development second contact portion 214 and the charging second contact portion 224 are exposed in a direction intersecting the S direction.

The development contact portion 110 and the charging contact portion 120 are provided on a rear side in the S direction as the attachment direction of the first unit 100. Therefore, a movement width of the development contact portion 110 and the charging contact portion 120 in the image formation device 10 when the first unit 100 is attached and detached is small as compared with a case where the development contact portion 110 and the charging contact portion 120 are provided on a front side in the S direction as that attachment direction of the first unit 100. Therefore, for example, when the first unit 100 is attached and detached, possibility that the development contact portion 110 and the charging contact portion 120 are in contact with other members or the like is reduced.

The first unit 100 is provided with the development branch portion 116 and the charging branch portion 126 that branch from the development contact portion 110 and the charging contact portion 120 to supply the power to the image formation unit 18 of each color. Therefore, the number of contact points may be reduced as compared with a case where a contact portion is provided for each image formation unit 18 of each color.

When the second unit 200 is attached, the transfer contact portion 232 provided in the second unit 200 is in contact with the power source side transfer contact portion 334 of the power source side transfer power supply path 330 provided in the power source unit 300, and the power is supplied from the power source unit 300 to the second unit 200. Therefore, the image formation device 10 may be downsized as compared with a case where a separate power source unit is provided for the second unit 200.

The second unit 200 is provided with the transfer branch portion 234 that branches from the transfer contact portion 232 and supplies the power to the primary transfer roll 68 of each color. Therefore, the number of contact points may be reduced as compared with a case where a contact portion is provided for each primary transfer roll 68 of each color.

<Others>

The present invention is not limited to the above exemplary embodiment.

For example, the first unit 100 is attached and detached in the device width direction and the second unit 200 is attached and detached in the device depth direction in the above exemplary embodiment, but the present invention is not limited thereto. The first unit 100 may be attached and detached in the device depth direction. The second unit 200 may be attached and detached in the device width direction. Attachment and detachment directions of the first unit 100 may be the same as attachment and detachment directions of the second unit 200.

For example, the first unit 100, the second unit 200 and the power source unit 300 disposed with the thickness direction as the upper-lower direction, are stacked in the order of the first unit 100, the second unit 200 and the power source unit 300 from the lower side in the above exemplary embodiment, but the present invention is not limited thereto. For example, the first unit 100, the second unit 200 and the power source unit 300 may be stacked in this order from an upper side. Alternatively, the first unit 100, the second unit 200 and the power source unit 300 disposed with the thickness direction as the device width direction or the device depth direction may be stacked in the order of the first unit 100, the second unit 200 and the power source unit 300 in the device width direction or the device depth direction.

The second unit 200 may be disposed between the first unit 100 and the power source unit 300.

A configuration of the image formation device is not limited to a configuration in the above exemplary embodiment, and various configurations may be employed. For example, the image formation device 10 forms the image on the recording medium by an electrophotographic method in the above exemplary embodiment, but the present invention is not limited thereto. For example, the present invention may be applied to an image formation device that forms an image on a recording medium by an inkjet method, an electrostatic recording method, a thermal transfer method or the like.

It should be understood that various modifications may be made without departing from the scope of the present invention.

REFERENCE SIGNS LIST

10 image formation device
10A device housing
18 image formation unit (example of image formation unit)
36 image carrier

66 intermediate transfer belt (example of intermediate transfer member)
66A outer end portion (example of outer end portion of intermediate transfer belt)
68 primary transfer roll (example of transfer roll)
70 tension roll
100 first unit
110 development contact portion (example of first-unit-side contact portion)
116 development branch portion (example of first-unit-side branch path)
120 charging contact portion (example of first-unit-side contact portion)
126 charging branch portion (example of first-unit-side branch path)
200 second unit
204A roll support member
205A outer end portion (example of outer end portion of roll support member, example of outer end portion of second unit in device width direction)
210 development power supply path (example of power supply path)
212 development first contact portion (example of path-side first contact portion)
214 development second contact portion (example of path-side second contact portion)
220 charging power supply path (example of power supply path)
222 charging first contact portion (example of path-side first contact portion)
224 charging second contact portion (example of path-side second contact portion)
230 transfer power supply path
232 transfer contact portion (example of second-unit-side transfer contact portion)
234 transfer branch portion (example of second-unit-side branch path)
300 power source unit
310 power source side development power supply path (example of power-source-side power supply path)
312 development base end portion (example of base end portion)
314 power source side development contact portion (example of power-source-side first contact portion)
320 power source side charging power supply path (example of power-source-side power supply path)
322 charging base end portion (example of base end portion)
324 power source side charging contact portion (example of power-source-side first contact portion)
330 power source side transfer power supply path
334 power source side transfer contact portion (example of power-source-side second contact portion)
P sheet member (example of recording medium)

What is claimed is:

1. An image formation device comprising:
a first unit for image formation, attachably and detachably disposed in the image formation device;
a power source unit configured to supply electric power to the first unit;
a second unit for image formation, attachably and detachably, independently of the first unit, disposed in the image formation device, and disposed between the first unit and the power source unit; and
a power supply path provided in the second unit, and configured to be supplied with the electric power from the power source unit and supply the electric power to the first unit.

2. The image formation device according to claim 1,
wherein when the first unit is deposed in the image formation device, the power supply path is configured to supply the electric power from the power source unit to the first unit.

3. The image formation device according to claim 1,
wherein the second unit comprises:
an intermediate transfer belt as an intermediate transfer member to hold a developer image formed by the first unit,
a tension roll disposed along a width direction of the image formation device and stretching the intermediate transfer belt,
a transfer roll disposed along the width direction and configured to transfer the developer image onto the intermediate transfer belt, and
a roll support member disposed at an outer end portion of the second unit in the width direction and supporting both end portions of the tension roll and the transfer roll, and
wherein the power supply path is provided at the roll support member.

4. The image formation device according to claim 3,
wherein the power supply path is provided between an outer end portion of the roll support member in the width direction and an outer end portion of the intermediate transfer belt in the width direction.

5. The image formation device according to claim 1,
wherein the power source unit is provided with a power-source-side first contact portion protruding toward the second unit, and
wherein the power supply path is provided with a path-side first contact portion exposed toward the power source unit so as to contact with the power-source-side first contact portion, the path-side first contact portion being provided more inward than the outer end portion of the second unit in a width direction of the image formation device.

6. The image formation device according to claim 5,
wherein the second unit is attachable and detachable to the image formation device, and
wherein when the second unit is attached to the image formation device, the path-side first contact portion is in contact with the power-source-side first contact portion.

7. The image formation device according to claim 1,
wherein the first unit is attachable and detachable to the image formation device,
wherein the power supply path includes a path-side second contact portion exposed rearward in an attachment direction of the first unit to the image formation device, and
wherein the first unit is provided with a first-unit-side contact portion that is in contact with the path-side second contact portion when the first unit is attached to the image formation device.

8. The image formation device according to claim 7,
wherein the first-unit-side contact portion is provided on a rear side of the first unit in the attachment direction to the image formation device of the first unit.

9. The image formation device according to claim 7,
wherein the first unit includes a plurality of image formation units that form a developer image, and wherein the first unit is provided with a first-unit-side branch path that branches from the first-unit-side contact portion so as to supply the electric power to the plurality of image formation units.

10. The image formation device according to claim 1, wherein the power source unit is configured to supply the electric power to both the first unit and the second unit, wherein the power source unit is provided with a power-source-side second contact portion protruding toward the second unit, wherein the second unit is attachable and detachable to the image formation device, and wherein the second unit is provided with a second-unit-side transfer contact portion that is in contact with the power-source-side second contact portion when the second unit is attached to the image formation device.

11. An image formation device comprising:

a first unit for image formation, attachably and detachably disposed in the image formation device;

a power source unit configured to supply electric power to the first unit;

a second unit for image formation, attachably and detachably, independently of the first unit, disposed in the image formation device, and disposed between the first unit and the power source unit; and a power supply path provided more inward than an outer end portion of the second unit in a width direction of the image formation device when viewed from a stacking direction of the power source unit and the second unit, and configured to supply the electric power from the power source unit to the first unit.

12. The image formation device according to claim 11, wherein the second unit includes:

an intermediate transfer belt as an intermediate transfer member to hold a developer image formed by the first unit, a tension roll disposed along the width direction and stretching the intermediate transfer belt, a transfer roll disposed along the width direction and configured to transfer the developer image onto the intermediate transfer belt, and a roll support member disposed at the outer end portion of the second unit in the width direction and supporting both end portions of the tension roll and the transfer roll, and wherein the power supply path is provided between an outer end portion of the roll support member in the width direction and an outer end portion of the intermediate transfer belt in the width direction.

13. The image formation device according to claim 12, wherein the power source unit is provided with a power-source-side power supply path connected to the power supply path, and wherein a base end portion of the power-source-side power supply path is disposed closer to the roll support member than a center position of the power source unit in the width direction.

14. The image formation device according to claim 13, wherein the power-source-side power supply path is provided with a power-source-side first contact portion protruding toward the second unit, wherein the power supply path is provided with a path-side first contact portion exposed toward the power source unit so as to contact with the power-source-side first contact portion and be supplied the electric power, the path-side first contact portion being provided more inward than the outer end portion of the second unit in the width direction, and wherein the power-source-side first contact portion and the path-side first contact portion overlap each other when viewed from the stacking direction of the power source unit and the second unit.

15. The image formation device according to claim 11, wherein the second unit is attachable and detachable to the image formation device, and wherein the power supply path is provided at the second unit.

16. The image formation device according to claim 11, wherein the first unit is attachable and detachable to the image formation device, wherein the power supply path is provided with a path-side second contact portion exposed rearward in an attachment direction of the first unit to the image formation device, and wherein the first unit is provided with a first-unit-side contact portion that is in contact with the path-side second contact portion when the first unit is attached to the image formation device, the first-unit-side contact portion being provided more inward than an outer end portion of the first unit in the width direction.

17. The image formation device according to claim 16, wherein the first-unit-side contact portion is provided on a rear side of the first unit in the attachment direction to the image formation device of the first unit.

18. The image formation device according to claim 16, wherein the first unit includes a plurality of image formation units to form a developer image, and wherein the first unit is provided with a first-unit-side branch path that branches from the first-unit-side contact portion so as to supply the electric power to the plurality of image formation units, the first-unit-side branch path being provided more inward than the outer end portion of the first unit in the width direction.

19. The image formation device according to claim 11, wherein the power source unit is configured to supply the electric power to both the first unit and the second unit, wherein the power source unit is provided with a power-source-side second contact portion protruding toward the second unit, wherein the second unit is provided with the power supply path and is attachable and detachable to the image formation device, and wherein the second unit is provided with a second-unit-side transfer contact portion that is exposed toward the power source and is in contact with the power-source-side second contact portion when the second unit is attached to the image formation device, the second-unit-side transfer contact portion being provided more inward than the outer end portion of the second unit in the width direction when viewed from the stacking direction of the power source unit and the second unit.

20. The image formation device according to claim 19, wherein the first unit includes a plurality of image formation units to form a developer image, wherein the second unit includes a plurality of transfer rolls configured to transfer the developer image onto the intermediate transfer member, the developer image being formed by the plurality of image formation units and wherein the second unit is provided with a second-unit-side branch path that branches from the second-unit-side transfer contact portion so as to supply the electric power to the plurality of transfer rolls, the second-unit-side branch path being provided more inward than the outer end portion of the second unit in the width direction.

* * * * *